US007497323B2

(12) United States Patent
Davidson et al.

(10) Patent No.: US 7,497,323 B2
(45) Date of Patent: Mar. 3, 2009

(54) MACHINE FOR ALIGNING AND EQUIPPING ARTICLES

(75) Inventors: Hartmut Davidson, Nittenforf (DE); Matthias Wahl, Langquaid (DE)

(73) Assignee: Krones AG, Neutraubling (DE)

( * ) Notice: Subject to any disclaimer, the term of this patent is extended or adjusted under 35 U.S.C. 154(b) by 565 days.

(21) Appl. No.: 11/133,062

(22) Filed: May 19, 2005

(65) Prior Publication Data

US 2005/0265881 A1 Dec. 1, 2005

(30) Foreign Application Priority Data

May 29, 2004 (DE) ..... 10 2004 026 755

(51) Int. Cl.
*B65C 9/04* (2006.01)

(52) U.S. Cl. ..... 198/474.1; 198/478.1

(58) Field of Classification Search ..... 198/474.1, 198/487.1, 377.01, 377.02, 378
See application file for complete search history.

(56) References Cited

U.S. PATENT DOCUMENTS 3,934,714 A * 1/1976 Matsumoto ..... 198/379
4,511,025 A * 4/1985 Nakayama ..... 198/377.08
5,326,422 A * 7/1994 Kronseder ..... 156/566
5,464,495 A * 11/1995 Eder ..... 156/456
5,478,422 A * 12/1995 Bright et al. ..... 156/64
5,858,143 A 1/1999 Bright et al.
6,398,006 B1 * 6/2002 Dault ..... 198/377.01

FOREIGN PATENT DOCUMENTS

| | | |
|---|---|---|
| DE | 1258784 | 1/1968 |
| DE | 1486138 | 10/1972 |
| DE | 3137201 | 3/1983 |
| DE | 3308934 | 11/1984 |
| EP | 1 174 345 A1 | 1/2002 |
| EP | 1 306 961 A1 | 5/2003 |
| WO | WO 00/44082 A | 7/2000 |

OTHER PUBLICATIONS

International Preliminary Report on Patentability; International Filing Date: May 24, 2005; Date of Issuance: Nov. 29, 2006.
International Preliminary Report on Patentability; International Filing Date: May 24, 2005; Date of Issuance: Nov. 29, 2006.

* cited by examiner

*Primary Examiner*—Douglas A Hess
(74) *Attorney, Agent, or Firm*—Marshall, Gerstein & Borun LLP

(57) ABSTRACT

A machine having a rotating table with multiple turntables for aligning and/or equipping containers, whereby each turntable is equipped with its own motor drive unit and the motor of the drive unit drives the turntable in an rpm ratio of approximately 1:1.

28 Claims, 3 Drawing Sheets

MACHINE FOR ALIGNING AND EQUIPPING ARTICLES

REFERENCE TO RELATED APPLICATIONS

Figure 1:
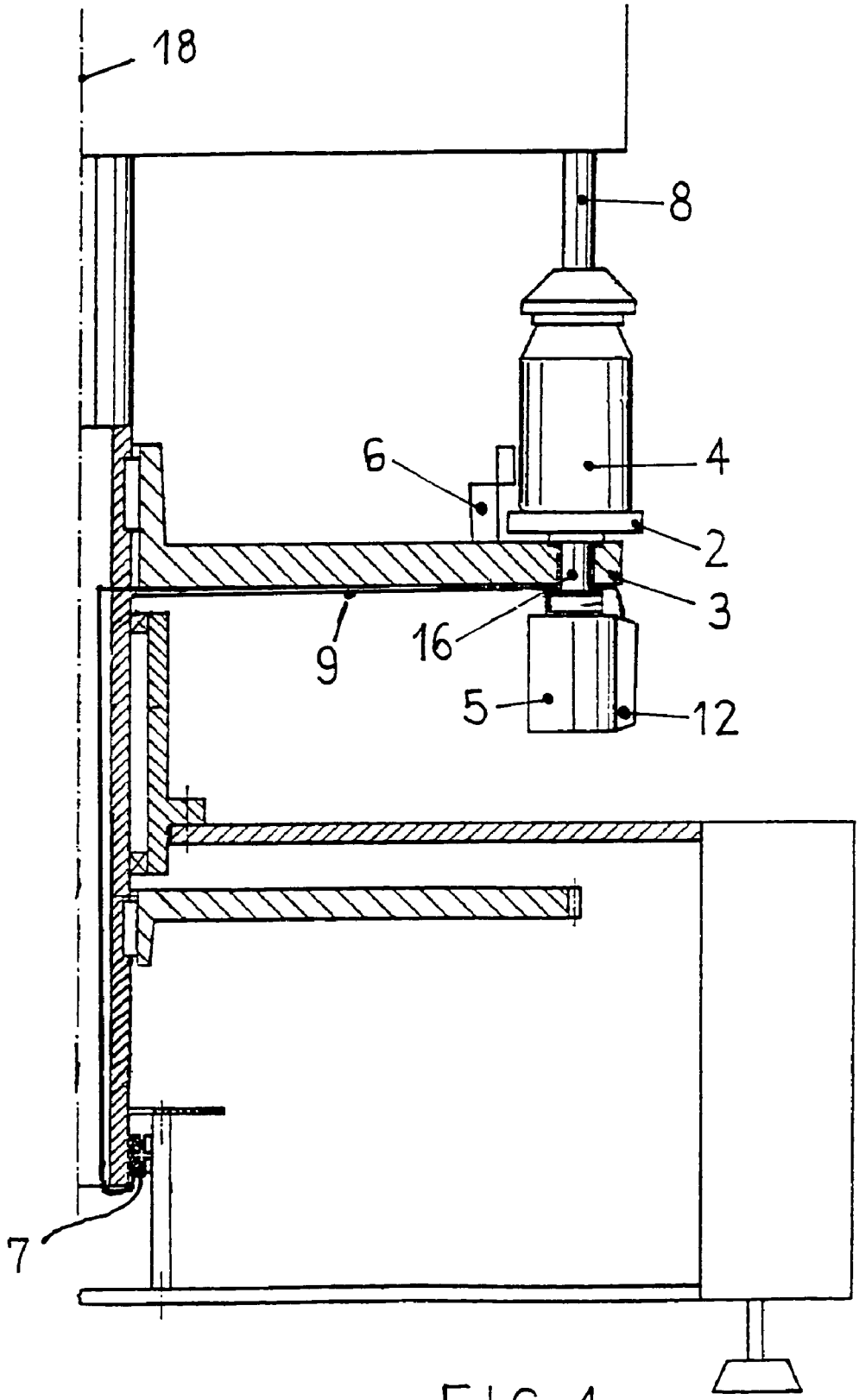

This disclosure claims priority to German application no. 102004026755.3, filed May 29, 2004.

FIELD OF THE DISCLOUSRE

This disclosure relates to a machine for aligning and equipping articles.

BACKGROUND OF THE DISCLOSURE

Such machines are known from a wide variety of fields. They are used in the beverage industry, for example, to align products for further processing. Further processing might include, for example, a check for certain features or labeling of the articles. In the case of labeling, if the containers are handled several times, alignment and realignment may be necessary even during the processing operation. This is accomplished with turntables mounted in the rotating table of the machine so that the articles to be processed are placed on this turntable. These turntables are brought into the respective position by control units and drive units.

Such a control unit may be a self-contained control cam, for example, with which roller levers act on the turntables either directly (DE-AS 1 486 138) or indirectly (DE-AS 1 258 784). There are known control devices and positioning devices with which gear wheels mounted on the side of the turntables facing away from the product engage with revolving toothed belts. The rotational movements to be generated with such equipment are used mainly in all-round labeling. If labeling machines must be adjusted quickly to different articles to be labeled, the control and positioning devices mentioned above rapidly reach their limits.

For such cases, there are already approaches which, when implemented, allow a wide variety of rotational movements to be implemented. Such an approach is disclosed in DE 31 37 201 A1, where an electric stepping motor is connected to each turntable for controlling same, said stepping motor supplying said turntable with control pulses as a function of the movement ratios of the rotating table. When switching to different containers to be labeled, it is thus no longer necessary to switch fittings that are involved in the rotational movement. One need only update the rotational and control program. DE 33 08 934 C1 also discloses a combination of a mechanical and a motor turntable drive.

However, with all the embodiments mentioned above, transmission elements that step down the rotational speed are needed between the turntable and the object generating the energy for rotation of the article to be aligned and/or equipped. With these transmission elements such as gears, shafts, toothed belts, etc., the required torque for rapid rotation of the articles to be aligned and/or equipped can be applied with traditional motors even at a high machine speed. However, such transmission element are subject to high wear, require regular maintenance and/or replacement and cause inaccuracies due to play.

SUMMARY OF THE DISCLOUSRE

The object of this disclosure is to create a machine of the type defined in the preamble with which alignment and/or equipment of articles is/are possible at low cost and with a high precision and at low cost.

The present disclosure relates to a machine for aligning and/or equipping containers. Containers are understood here to refer to articles of a wide variety of types and shapes. They may be bottles, cans or canisters, for example. The term "equipping" as used here may refer to various processes such as labeling, inscribing or wearing. The containers then stand on turntables, preferably having a round, essentially flat shape. The turntables frequently have indentations or elevations for centering the containers. In addition to the round and/or flat turntables, however, other designs are also conceivable. The turntables are rotatably mounted on a table rotating about a stationary axis, preferably a vertical axis. However, linear tables and/or conveyors having turntables are also conceivable.

Each turntable on the rotary table is equipped with its own motor drive unit, e.g., an electric synchronous or asynchronous motor. The turntable is connected to its drive unit in such a way that it is driven in a 1:1 rpm ratio by the motor of the drive unit. The rotational speed of the turntable corresponds to that of the rotating field of the motor. The drive shaft of the motor is concentric with the axis of rotation of the turntable. This eliminates the need for coupling elements to compensate for an axial offset. This is a so-called direct drive, which does not require an intermediate connection of high-wear transmission elements between the motor output shaft and the turntable for stepping down the rotational speed.

In an especially preferred embodiment, the drive unit consists of a direct drive and a control unit so that each direct drive has its own control unit. In another preferred embodiment, the control unit is situated directly on the direct drive. Therefore, no complex connections or exposed cabling is necessary.

The motor of the drive unit may have various designs. For example, it may be a multi-way servo motor in a conventional design, a disk-type rotor motor or an external rotor motor. In the case of an external rotor motor, an embodiment as a bell-type armature motor is especially advantageous. This has the advantage that it supplies a higher torque in comparison with the internal rotor motor with the same design size due to the greater diameter of the rotor. A particularly compact design may be achieved with the bell-type armature motor when the rotating rotor simultaneously functions as a turntable for the object to be aligned and/or equipped. However, a separate turntable may also be mounted on the bell-type armature. The bell-type armature may be supported directly via a rotary bearing or with an intermediate connection of a baseplate on the rotary table of the machine.

In another preferred embodiment, the control units are designed to communicate with one another. Such a connection may be implemented either as a hardwired system or as a wireless system. A wireless embodiment might be, for example, an infrared connection or a Bluetooth connection, whereas a hardwired embodiment would be implemented as a bus system, for example. If a bus system is used, the control units are preferably interconnected via a ring line. In a particularly preferred embodiment, the bus system used is a CAN bus. A wide variety of information can be exchanged and modified over such a communication system, e.g., the instantaneous position of the rotary table or the rotational program for the respective turntable may be input, exchanged and modified.

The rotating program for the turntable for alignment of the containers is preferably stored as a sixth-degree polynomial in the control units. If the machine is to be switched to different articles to be aligned and/or equipped, then it is no longer necessary to replace fittings (control cams, feed belts or the like) but instead the rotational program for the turntable is adapted to the particular articles and/or a different rotational program that has already been stored is retrieved from a memory. Input of current rotational programs may be accomplished, e.g., via a programming device, then forwarded to the programmable controller of the machine and distributed via the bus system to all the control units.

To be able to always state the position of the turntable accurately, it is necessary to use a position sensor. This is preferably mounted concentrically on the motor output shaft. A resolver is preferably used as the position sensor. A sensor is assigned to each turntable for alignment of the containers. Such sensors may be, for example, optical sensors such as light scanners, optical barriers or camera systems. However, other sensor systems are also conceivable, e.g., systems that operate magnetically or acoustically. They need merely be adapted to certain recognition features of the containers to be aligned and/or equipped in order to recognize their individual features. The sensors assigned to the turntables are preferably connected directly to the control unit.

In another embodiment, it is possible to provide not one sensor for each turntable but instead to mount a central stationary sensor/camera on the machine. The position of the containers is recognized as they pass by the sensor and this information is relayed via the bus system to the respective control devices of the turntables to then align the devices accordingly. In both cases, the sensor signals are analyzed in the control unit, which is in the drive unit. The signals thus analyzed are relayed to the drive unit in the form of control pulses, such that the containers on the turntable can then be rotated into the correct position by the shortest path. In a preferred embodiment, the shaft from the motor to the turntable is not designed in one piece but instead is in two pieces and has a floating-type bearing. The housing is divided into two parts, with the first part comprising the rotor of the motor and the control unit. The second part of the housing is preferably designed as a bearing bracket which may be used as a bushing in the rotary table in another preferred embodiment. This embodiment also saves greatly in terms of space. A receptacle device is integrated into the bearing bracket; on its side facing away from the rotary table, it may accommodate the motor shaft, and on its side facing the rotary table it may accommodate the turntable. The turntable is equipped with a device which can be brought into engagement with the receptacle device. Such a device may be, for example, a journal, a pin or a hollow shaft. The device may be smooth, threaded or designed as a quick-action closure. The quick-action closure may be designed as a snap closure, for example.

In a preferred embodiment, the second bearing of the floating bearing of the motor shaft is situated in the second part of the housing and thus at the same time serves as the bearing for the receptacle unit. The bearing is designed so that forces acting on the turntable are not dissipated via the motor output shaft but instead via the housing of the drive device. Using this receptacle device has the advantage that an inexpensive, space saving and easy-to-maintain embodiment can be implemented because the bearing of the receptacle device also serves as the bearing for the motor. In addition, when replacing the turntable or the drive unit, the other part may remain on the rotating table.

BRIEF DESCRIPTON OF THE DRAWNINGS

Figure 2:
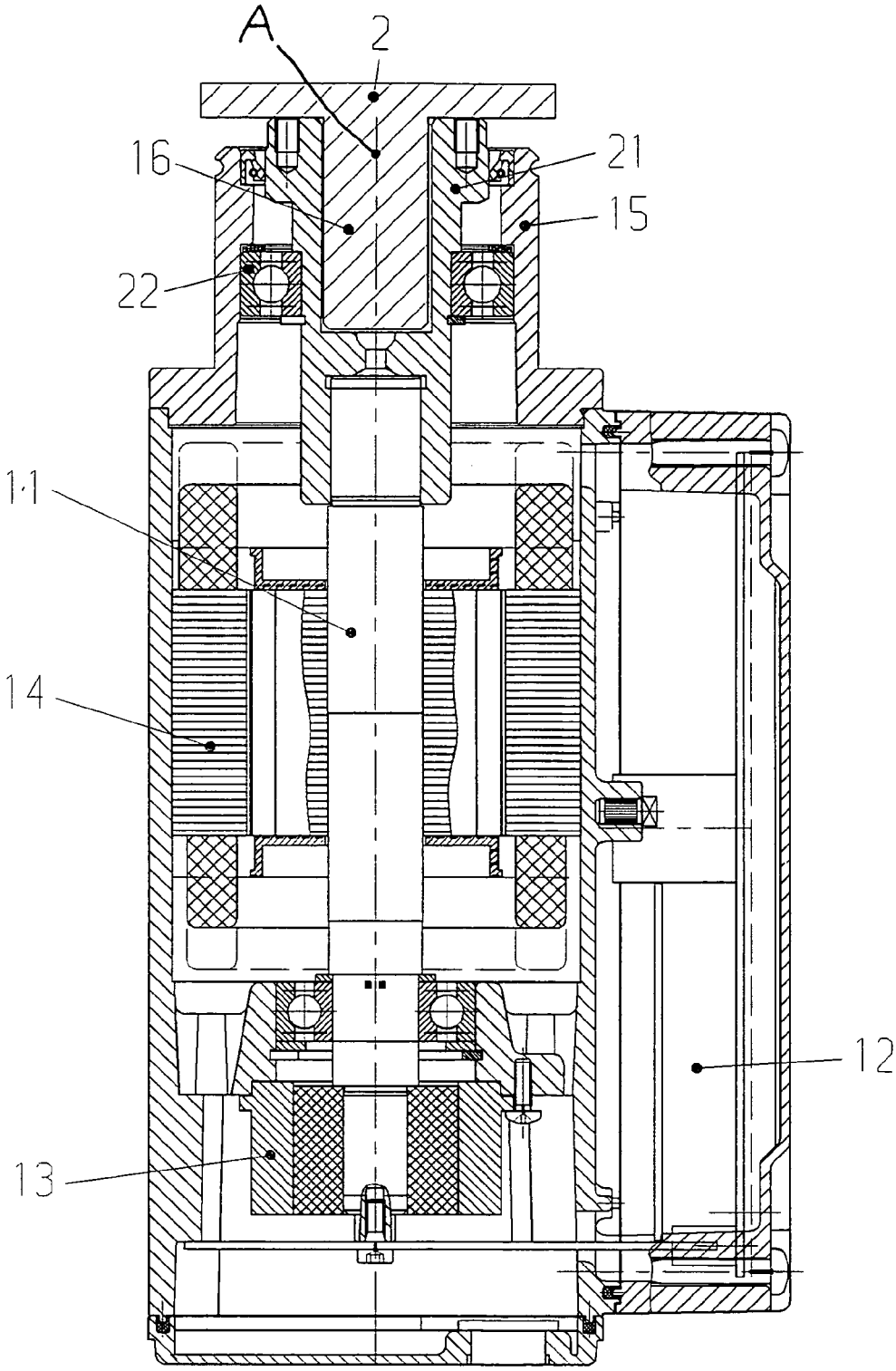
Figure 3:
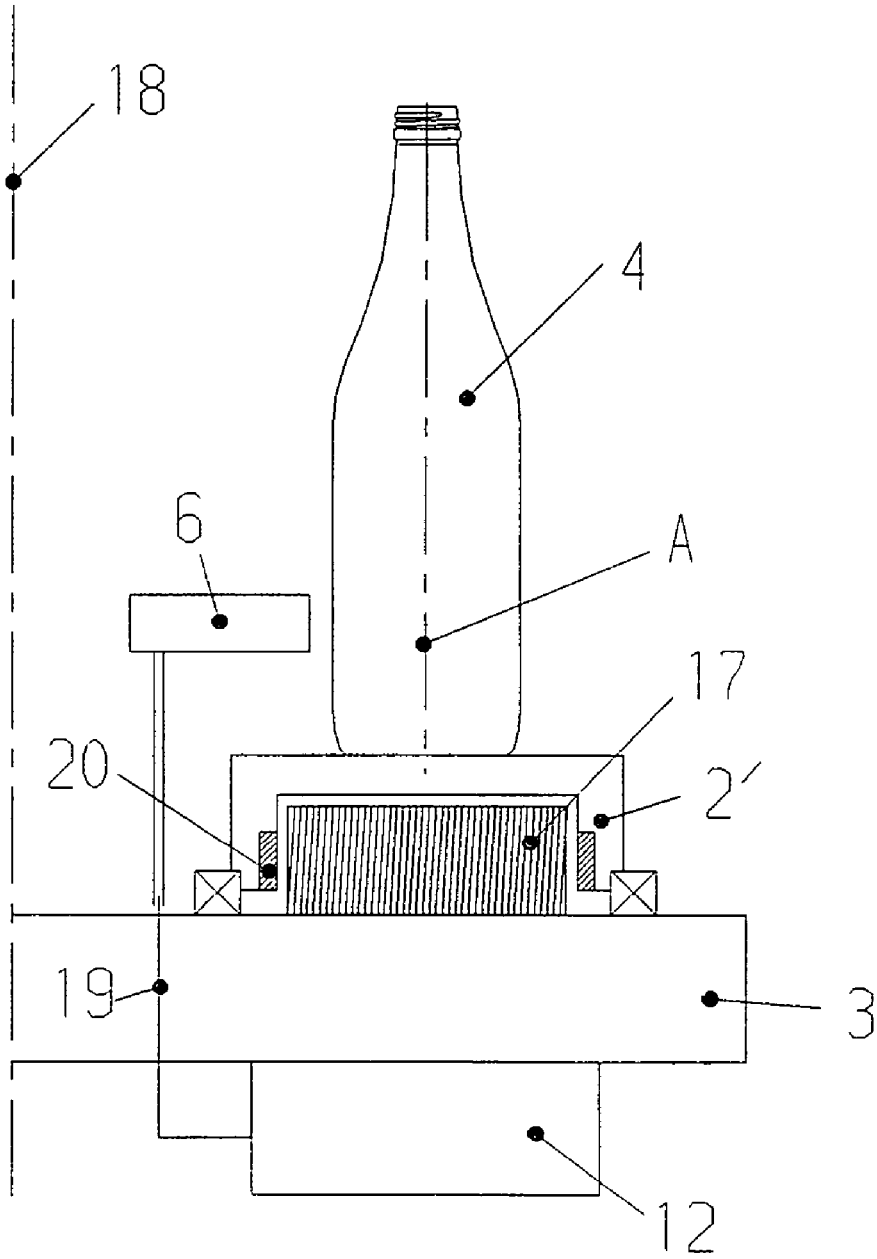

An exemplary embodiment of this disclosure is described in greater detail below with reference to the figures, in which:

FIG. 1 shows a vertical section through one half of an aligning and/or equipping machine, FIG. 2 shows a longitudinal section through a drive unit of a turntable of an aligning and/or equipping machine, and FIG. 3 shows another embodiment of a drive unit and a turntable of an aligning and/or equipping machine.

DETAILED DESCRIPTION OF THE DISCLOSURE

The container 4 depicted in FIG. 1 is a can which is pressed against a turntable 2 mounted on a rotary table 3 with the help of a fastening device 8 which can be raised and lowered vertically in a controlled manner for the purpose of aligning and/or equipping containers. Beneath the rotary table 3 which is mounted so it can rotate about a vertical main axis 18, the motor drive unit 5 for the turntable 2 and the respective control unit 12 is attached. The motor output shaft 11 is aligned concentrically with the axis A of rotation of the turntable 2 and/or of the container 4 (see FIG. 2).

In a space-saving manner, the control unit 12 is connected directly to the drive unit 5. A sensor 6 detects the rotational position of the container 4 in relation to the rotating table and sends this information to the control unit 12 connected to it so that a desired alignment of the container can be achieved. The turntable 2 is rotationally connected to the drive unit 5 via a pin 16 which passes through the rotating table 3. The instantaneous machine position and/or rotating table position of the aligning and/or equipping machine is determined via a rotary pulse generator 7. The position information thus obtained is transmitted via a bus line 9 to the control unit 12 and from there is relayed over a bus ring line (not shown) to all other control units of the adjacent turntable which is situated on a shared partial circuit.

FIG. 2 shows centrally the motor output shaft 11 of the drive unit 5 illustrated here in longitudinal section. The upper end of the motor output shaft 11 is in a rotationally fixed position but is axially insertable in the lower end (borehole) of a receptacle unit 21 which is arranged concentrically. The upper end of this receptacle unit 21 may accommodate a device 16 in a rotationally fixed manner like that of the turntable 2 shown in FIG. 1. In the embodiment shown in FIG. 2, this device is designed as an axially insertable journal 16.

The receptacle unit 21 is rotatably mounted in the bearing bracket 15 of the drive unit 5 by means of a bearing 22. The bearing 22 may be designed as a fixed bearing. The bearing bracket 15 forms a second part which is detachable from the overall housing of the drive unit 5. It may be removed axially from the remaining housing of the drive unit 5, which accommodates the motor windings 14 so that the motor output shaft 11 of the drive unit 5 is freely visible. The bearing bracket 15 is at the same time designed externally as a bushing so that it can be inserted from beneath into a receptacle bore in the rotating table 3 of an aligning and/or equipping machine and can be attached to it, e.g., with screws.

If it is necessary to replace the motor drive unit 5, the bearing bracket 15 can remain in the rotating table 3 with the receptacle unit 21 and the turntable 2. If only the turntable 2 need be replaced, it is simply pulled with its journal 16 upward out of a borehole in the receptacle device 21.

If the bearing bracket 15 is removed from the drive unit 5, it is not ready for operation, because then the second bearing for the motor output shaft 11 is missing. The bearing 22 in the receptacle unit 21 in the bearing bracket 15 is arranged and designed in such a way (fixed bearing) that the forces transmitted to the turntable 2 in restraining the containers 4 are not diverted via the motor shaft 11 to the rotating table but instead are diverted via the bearing bracket 15 of the drive unit 5. The lower bearing of the motor shaft 11 can therefore be designed as a simple loose bearing.

The control unit 12 is situated directly on the drive unit 5. It transmits control commands to the drive unit 5, whereupon the motor of the drive unit 5 moves accordingly. At the lower end of the motor output shaft 11 there is a position sensor 13 which is designed as a resolver and transmits the position information of the motor output shaft 11 and thus of the turntable 2 back to the control unit 12.

FIG. 3 shows a variant of a drive unit with an external rotor motor in a longitudinal section in which the container 4 does not stand on a separate turntable 2 but instead is on a rotatable housing 2' of the motor. The rotatable housing 2' which is furnished with multiple magnets on its inside radially is at the same time the rotor surrounding the stator 17 of the electric motor (bell-type armature). The stator 17 having the motor windings is secured on the rotating table 3 in a rotationally fixed manner. The housing 2' is supported directly on the rotating table 3 by at least one rotating bearing arranged concentrically with the stator 17 so it can rotate about a vertical axis A. The components of the external rotor motor, however, may also be mounted on a baseplate which is detachable from the rotating table in a manner not depicted here and thus may form a quickly replaceable unit. This external rotor design permits a direct drive of a turntable without a motor shaft in principle, following the rotational field of the motor directly in an rpm of 1:1 and requiring only a minimum number of components. The instantaneous rotational position of the turntable is detectable via a rotary transducer (not shown in detail here).

The sensor 6 detects the rotational position of the container 4 and relays this information over a line 19 directly to the control unit 12. The control unit 12 assigned to the motor is in this case mounted in a protected position beneath the rotating table 3 and is connected for the purpose of communication to the other control units 12 of the other turntables 2'. In deviation from the drawing in the diagram, the control unit together with the motor may form a spatially unified unit.

The invention claimed is:

1. Machine having a rotating table which has a plurality of turntables for aligning and/or equipping containers, comprising each turntable equipped with its own motor drive unit, and a motor of the drive unit drives the turntable in an rpm ratio of 1:1;

a motor output shaft of the drive unit has a floating mounting; and a housing of the drive unit includes a first part and a second part, whereby the first part accommodates a rotor and motor windings of the drive unit and a control unit, and the second part forms a bearing bracket for the motor output shaft.

2. Machine according to claim 1, wherein the output shaft of the motor is concentrically arranged with the axis of rotation of the turntable.

3. Machine according to claim 2, wherein a rotational program is stored as a sixth-degree polynomial in the respective control unit for each turntable.

4. Machine according to claim 1 wherein the motor drive unit consists of a direct drive and a respective control unit.

5. Machine according to claim 4, wherein the control unit is situated directly on the direct drive.

6. Machine according to claim 4, wherein the control units are linked together to allow communication among them.

7. Machine according to claim 6, wherein the communicative link is a bus system.

8. Machine according to claim 7, wherein the system is a CAN bus.

9. Machine according to claim 6, and information regarding the instantaneous rotational table position is relayed via the communication system to each control unit.

10. Machine according to claim 1, wherein the drive unit is a multi-way servo motor.

11. Machine according to claim 1, wherein the drive unit is an external rotor motor.

12. Machine according to claim 11, wherein the drive unit has a rotating housing which one of forms or directly accommodates the turntable.

13. Machine according to claim 1, wherein the drive unit is a disk-type rotor motor.

14. Machine according to claim 11, wherein the external rotor motor is a bell-type armature motor.

15. Machine according to claim 11, wherein the drive unit comprises an external bell-type armature motor.

16. Machine according to claim 1, and a position generator is provided for detecting the position of the turntable.

17. Machine according to claim 16, wherein the position generator is a resolver.

18. Machine according to claim 16, wherein the position generator is situated concentrically on the motor output shaft.

19. Machine according to claim 18, wherein the position generator is situated on the end of the shaft pointing away from the turntable.

20. Machine according to claim 1, and a sensor for aligning a container is assigned to each turntable.

21. Machine according to claim 20, wherein the sensor is directly connected to the control unit assigned to the drive unit of the turntable.

22. Machine according to claim 21, wherein the analysis of the signal for alignment of the container is performed in the control unit.

23. Machine according to claim 1, wherein the bearing bracket is partially designed as a bushing which engages in the rotating table of the machine.

24. Machine according to claim 1, and a receptacle unit which is integrated into the bearing bracket accommodates on its upper side facing away from the rotating table the upper part of the output shaft of the motor and on its side facing the rotating table accommodates a turntable.

25. Machine according to claim 24, wherein the turntable has devices which are accommodated by the side of the receptacle unit facing the rotating table.

26. Machine according to claim 24, wherein the receptacle unit is supported in the bearing bracket whereby this bearing bracket at the same time forms the second bearing of the output shaft of the motor of the drive unit.

27. Machine according to claim 26, wherein the bearing bracket forming the second bearing is designed as a fixed bearing.

28. Machine for aligning and/or equipping containers, comprising:

a rotating table;

a plurality of turntables associated with the rotating table, the turntables for aligning and/or equipping the containers, each turntable equipped with a motor drive unit comprising a motor adapted to drive the respective turntable in an rpm ratio of 1:1, wherein each motor is an external rotor motor and comprises a rotating housing which forms the respective turntable, wherein the motor is seated on an upper surface of the rotating table.

* * * * *

UNITED STATES PATENT AND TRADEMARK OFFICE

CERTIFICATE OF CORRECTION

PATENT NO. : 7,497,323 B2
APPLICATION NO. : 11/133062
DATED : March 3, 2009
INVENTOR(S) : Hartmut Davidson et al.

It is certified that error appears in the above-identified patent and that said Letters Patent is hereby corrected as shown below:

On the Cover Page:

Item (30), "10 2004 026 755" should be -- 102004026755.3 --.

Signed and Sealed this

Twenty-first Day of July, 2009

JOHN DOLL
*Acting Director of the United States Patent and Trademark Office*